US008196702B2

(12) United States Patent
Park et al.

(10) Patent No.: US 8,196,702 B2
(45) Date of Patent: Jun. 12, 2012

(54) MUFFLER FOR VEHICLE

(75) Inventors: Kichul Park, Suwon-si (KR); Daegil Hwang, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 12/956,121

(22) Filed: Nov. 30, 2010

(65) Prior Publication Data

US 2012/0085589 A1 Apr. 12, 2012

(30) Foreign Application Priority Data

Oct. 8, 2010 (KR) ..... 10-2010-0098112

(51) Int. Cl.
*F01N 13/00* (2010.01)
*F01N 1/12* (2006.01)

(52) U.S. Cl. ..... 181/239; 181/252; 181/256; 181/264; 181/272

(58) Field of Classification Search ..... 181/227, 181/228, 238, 239, 251, 252, 253, 254, 255, 181/256, 257, 264, 268, 269, 272, 273, 275
See application file for complete search history.

(56) References Cited

U.S. PATENT DOCUMENTS

| | | | | | |
|---|---|---|---|---|---|
| 2,553,326 | A | * | 5/1951 | Manning | 96/387 |
| 4,064,963 | A | * | 12/1977 | Kaan et al. | 181/244 |
| 4,124,091 | A | * | 11/1978 | Mizusawa | 181/231 |
| 4,203,503 | A | * | 5/1980 | Franco et al. | 181/272 |
| 4,601,363 | A | * | 7/1986 | Harris et al. | 181/280 |
| 4,605,092 | A | * | 8/1986 | Harris et al. | 181/280 |
| 5,025,890 | A | * | 6/1991 | Hisashige et al. | 181/272 |
| 5,183,977 | A | * | 2/1993 | Horitani | 181/266 |
| 5,365,025 | A | * | 11/1994 | Kraai et al. | 181/249 |
| 6,241,044 | B1 | * | 6/2001 | Nishiyama et al. | 181/272 |
| 6,467,570 | B1 | * | 10/2002 | Herold | 181/231 |
| 6,668,972 | B2 | * | 12/2003 | Huff et al. | 181/256 |
| D515,461 | S | * | 2/2006 | Lai | D12/92 |
| D543,920 | S | * | 6/2007 | Lai | D12/196 |
| 7,562,741 | B2 | | 7/2009 | Winklel et al. | |
| 7,789,195 | B2 | | 9/2010 | Mabuchi et al. | |

FOREIGN PATENT DOCUMENTS

| | | | |
|---|---|---|---|
| EP | 1 914 398 | A1 | 4/2008 |
| JP | 62-615 | A | 1/1987 |
| JP | 9-209739 | A | 8/1997 |
| JP | 10-299473 | A | 11/1998 |
| JP | 2006-250055 | A | 9/2006 |
| JP | 2007-205275 | A | 8/2007 |

* cited by examiner

*Primary Examiner* — Jeremy Luks
(74) *Attorney, Agent, or Firm* — Morgan, Lewis & Bockius LLP

(57) ABSTRACT

A muffler for a vehicle includes a plurality of baffles fixed at a predetermined distance in a longitudinal direction of a muffler housing, an exhaust gas inflow pipe, an intermediate pipe, and a plurality of exhaust gas outflow pipes having an inlet thereof positioned in the same chamber defined by the adjacent pair of the baffles with the outlet of the intermediate pipe to considerably reduce exhaust noise, flow-induced noise, and booming noise of exhaust gas. The muffler is effectively protected from thermal damage of a vehicle by implementing a sound-absorbing heat-insulating material therein, and impresses consumers with dynamic, powerful, and polished image by making the exhaust gas outflow pipe in a dual type composed of first and second exhaust gas outflow pipes and disposing the outlet at the lower center of a rear bumper to be exposed to the outside, thereby considerably improving productivity of vehicles.

9 Claims, 2 Drawing Sheets

MUFFLER FOR VEHICLE

CROSS-REFERENCE TO RELATED APPLICATIONS

The present application claims priority to Korean Patent Application Number 10-2010-0098112 filed Oct. 8, 2010, the entire contents of which application is incorporated herein for all purposes by this reference.

BACKGROUND OF THE INVENTION

1. Field of the Invention

The present invention relates to a muffler for a vehicle, and more particularly, to a muffler for a vehicle having dual exhaust gas outflow pipe with the outlet under the center of the rear bumper.

2. Description of Related Art

Mufflers for vehicles in the related art have a plurality of chambers that are formed by one or more baffles in a closed muffler housing having a predetermined volume, an exhaust gas inflow pipe through which an exhaust gas flows inside the muffler housing, and an exhaust gas outflow pipe through which an exhaust gas flows outside the muffler housing, in which the exhaust gas that has flowed inside the muffler housing through the exhaust gas inflow pipe, flows through an exhaust channel formed in the muffler housing, and consequently flows outside the muffler housing through the exhaust gas outflow pipe, with the pressure and sound reduced.

However, since the mufflers commonly used in the related art have a single exhaust gas outflow pipe, particularly for small-sized vehicles, it is difficult to give dynamic and powerful image to consumers. Further, since the outlet of the exhaust gas outflow pipe is positioned at the right end or the left end of the rear bumper, productivity is difficult to appeal to young consumers following polished image.

The information disclosed in this Background section is only for enhancement of understanding of the general background of the invention and should not be taken as an acknowledgement or any form of suggestion that this information forms the prior art already known to a person skilled in the art.

BRIEF SUMMARY OF THE INVENTION

The present invention has been made in an effort to provide a muffler for a vehicle that can impress consumers with dynamic, powerful, and polished image by making the exhaust gas outflow pipe in a dual type and disposing the outlet of the exhaust gas outflow pipe at the lower center of the rear bumper, thereby contributing to improving productivity of vehicles.

Further, the present invention has been made in an effort to provide a muffler for a vehicle which is manufactured in a small size to be applied to small vehicle, sufficiently reduces exhaust noise, flow-induced noise, and booming noise of exhaust gas, and reduces thermal damage, thereby improving durability.

Various aspects of the present invention provide a muffler for a vehicle, which includes a plurality of baffles fixed at a predetermined distance in the longitudinal direction of a muffler housing in the muffler housing, an exhaust gas inflow pipe having an inlet connected with the muffler through the front of the muffler housing and an outlet fixed inside the muffler housing through the baffle, an intermediate pipe fixed through the baffles in the muffler housing such that an inlet is positioned with the outlet of the exhaust gas inflow pipe in any one chamber divided by the baffles, and a plurality of exhaust gas outflow pipes having an inlet positioned with the outlet of the intermediate pipe in the same chamber such that the exhaust gas passing through the intermediated pipe can be discharged outside the muffler housing and an outlet protruding outward through the muffler housing such that the discharging direction of the exhaust gas does not meet the input direction of the exhaust gas into the inlet pipe, without passing through the baffles.

Preferably, the first, second, and third baffles are fixed at a predetermined distance in the longitudinal direction of the muffler housing in the muffler housing, the internal space of the muffler housing is divided into first, second, third, and fourth chambers by the first, second, and third baffles, the exhaust gas inflow pipe has an inlet protruding outside through the front of the muffler housing and an outlet positioned in the second chamber through the first baffle, the intermediate pipe is disposed through the second baffle in the longitudinal direction of the exhaust gas inflow pipe such that the inlet is positioned with the outlet of the exhaust gas inflow pipe in the second chamber and the outlet is positioned in the third chamber, and the exhaust gas outflow pipe is disposed such that an inlet is positioned with the outlet of the intermediate pipe in the third chamber and an outlet protrudes outside through the side of the muffler housing.

The exhaust gas outflow pipes make a dual pipe composed of a first and second exhaust gas outflow pipes and the outlets of the first and second exhaust gas outflow pipes are exposed to the outside at the lower center of the rear bumper.

According to various aspects of the present invention, a muffler for a vehicle can be achieved in a small size and applied to small vehicles because it can considerably reduce exhaust noise, flow-induced noise, and booming noise of exhaust gas, has largely improved durability because it can be effectively protected from thermal damage from a vehicle by improving heat insulating performance, and impresses consumers with dynamic, powerful, and polished image by making the exhaust gas outflow pipe in a dual type composed of first and second exhaust gas outflow pipes and disposing the outlet at the lower center of a rear bumper to be exposed to the outside, thereby considerably improving productivity of vehicles.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
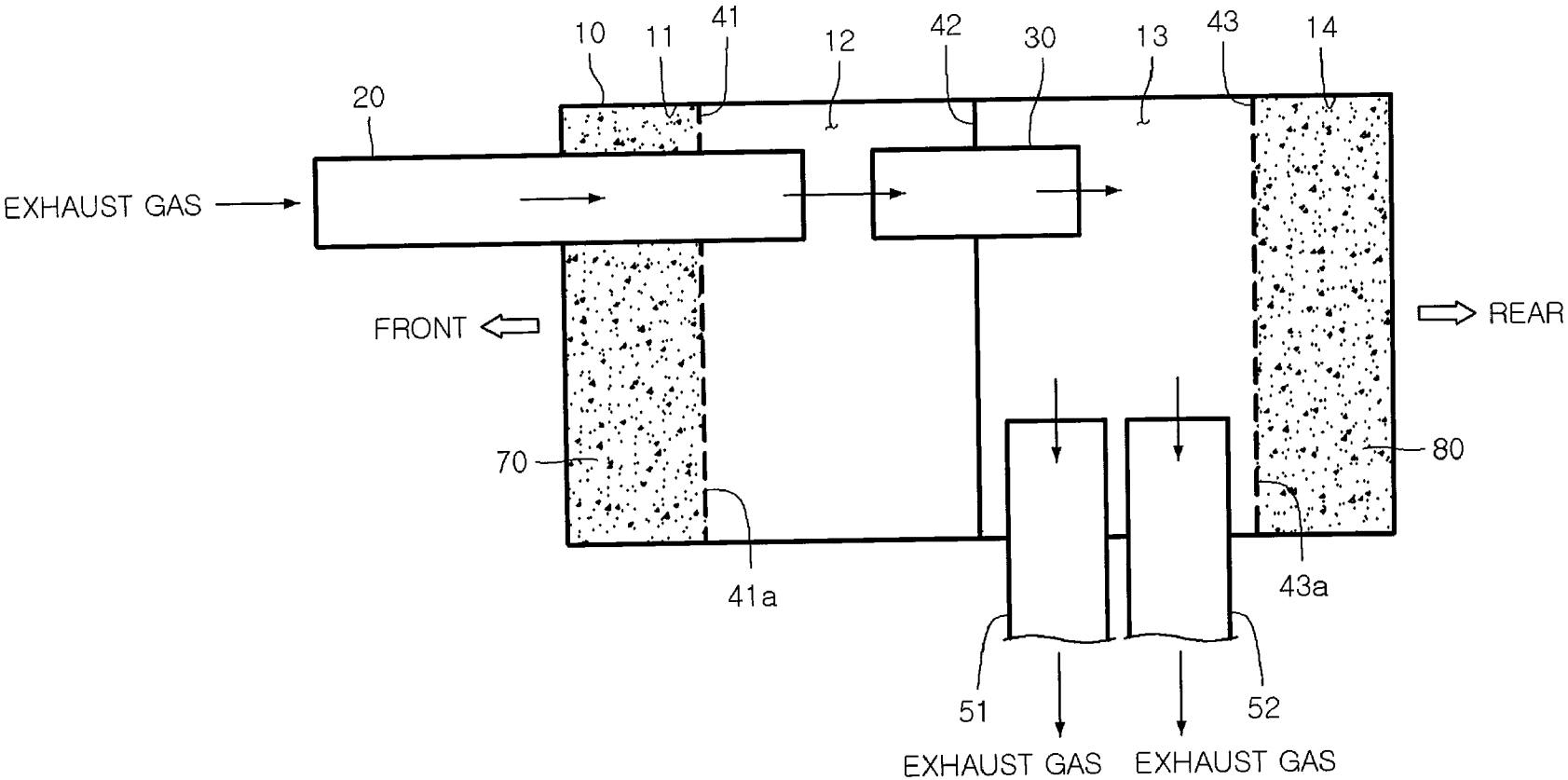
FIG. 1 is a cross-sectional view of an exemplary muffler for a vehicle according to the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 2:
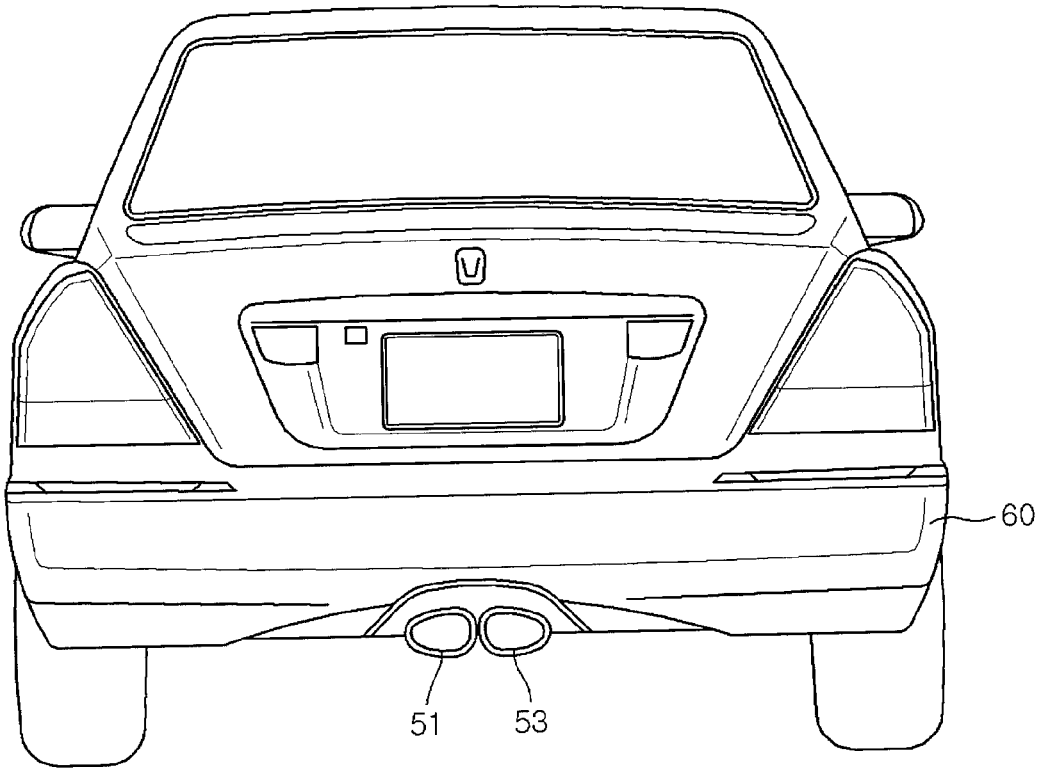
FIG. 2 is a front view of the rear side of a vehicle equipped with the exemplary muffler for a vehicle according to the present invention.

A muffler for a vehicle according various embodiments of the present invention, as shown in FIGS. 1 and 2, includes a plurality of baffles fixed at a predetermined distance in the longitudinal direction of a muffler housing 10 in muffler housing 10, which has a predetermined closed volume, an exhaust gas inflow pipe 20 having an inlet connected with the muffler through the front of muffler housing 10 and an outlet fixed inside muffler housing 10 through the baffle, an intermediate pipe 30 extending straight in a line with exhaust gas inflow pipe 20 through the baffles in muffler housing 10, and having an inlet positioned with the outlet of exhaust gas inflow pipe 20 in any one chamber divided by the baffles, and a plurality of exhaust gas outflow pipes having an inlet positioned with outlet of intermediate pipe 30 in the same chamber such that the exhaust gas passing through the intermediated pipe 30 can be discharged outside muffler housing 10 and an outlet protruding outward through muffler housing 20 such that the discharging direction of the exhaust gas does not meet the input direction of the exhaust gas into the inlet pipe, without passing through the baffles.

That is, first, second, and third baffles 41, 42, and 43 are fixed at a predetermined distance in the longitudinal direction of muffler housing 10 in muffler housing 10, and accordingly, the internal space of muffler housing 10 is divided into first, second, third, and fourth chambers 11, 12, 13, and 14 by first, second, and third baffles 41, 42, and 43.

Further, exhaust gas inflow pipe 20 has an inlet protruding outside through the front of muffler housing 10 and an outlet positioned in second chamber 12 through first baffle 41.

Further, intermediate pipe 30 is disposed in a straight line through second baffle 42 in the longitudinal direction of exhaust gas inflow pipe 20, in which the inlet is positioned with the outlet of exhaust gas inflow pipe 20 in second chamber 12 and the outlet is positioned in third chamber 13.

Further, the exhaust gas outflow pipe is disposed such that an inlet is positioned with the outlet of intermediate pipe 30 in third chamber 13 and an output protrudes outside through the side of muffler housing 10.

According to various embodiments of the present invention, the exhaust gas outflow pipes make a dual pipe composed of first and second exhaust gas outflow pipes 51 and 52, and the outlets of first and second exhaust gas outflow pipes 51 and 52 are exposed to the outside at the lower center of a rear bumper 60.

As described above, since the exhaust gas outflow pipe makes a dual pipe composed of first and second exhaust gas outflow pipes 51 and 52 and the outlet is positioned at the lower center of rear bumper 60 and exposed to the outside, a dynamic, powerful, and polished image can appeal to consumers, such that it is possible to considerably improve productivity of vehicles.

In particular, for small vehicles, productivity can impressively appeal to young consumers.

Therefore, the exhaust gas that has flowed in second chamber 12 of muffler housing 10 through exhaust gas inflow pipe 20 flows into third chamber 13 through intermediate pipe 30.

In this process, the movement space of the exhaust gas also largely increases from exhaust gas inflow pipe 20 to second chamber 12, such that the exhaust gas decreases in pressure and speed, thereby significantly reducing exhaust noise, flow-induced noise, and booming noise.

Further, the movement space of the exhaust gas also largely increases from intermediate pipe 30 to third chamber 13, such that the exhaust gas decreases in pressure and speed, thereby significantly reducing again exhaust noise, flow-induced noise, and booming noise.

Further, the exhaust gas in third chamber 13 is finally discharged outside muffler housing 10 through first and second exhaust gas outflow pipes 51 and 52 making the dual pipe, in which the exhaust gas outflow pipe is formed of the dual pipe composed of first and second exhaust gas outflow pipes 51 and 52, such that resistance in flow of the exhaust gas is largely reduced, which considerably contributes to reducing exhaust noise and flow-induced noise and improving the output.

Further, in the muffler for a vehicle according to various embodiments of the present invention, first and fourth chambers 11 and 14 are filled with sound-absorbing materials 70 and 80 to protect the muffler against thermal damage of the vehicle by improving heat insulating performance at the front and rear portions of the muffler, where sound-absorbing materials are glass wool.

As described above, since first and fourth chambers 11 and 14 are filled with sound-absorbing materials 70 and 80, the front and rear portions of the muffler can be sufficiently protected against thermal damage from the vehicle, such that durability of the muffler can be considerably improved.

Further, the muffler for a vehicle according to various embodiments of the present invention has a structure having a plurality of connection channels 41*a* connecting first and second chambers 11 and 12 to first baffle 41.

Accordingly, some of the exhaust gas in second chamber 12 is sucked into sound-absorbing material 70 of first chamber 11 through connection channels 41*a*, and as a result, it is possible to considerably reduce high-frequency exhaust noise.

Further, the muffler for a vehicle according to various embodiments of the present invention has a structure having a plurality of connection channels 43*a* connecting third and fourth chambers 13 and 14 to third baffle 43.

Accordingly, some of the exhaust gas in third chamber 13 is sucked into sound-absorbing material 80 of fourth chamber 14 through connection channels 43*a*, and as a result, it is possible to considerably reduce high-frequency exhaust noise.

Meanwhile, the installation space is small in small vehicles, such that it is required to reduce the size of the muffler, however, in this case, the exhaust noise, flow-induced noise, and booming noise of the exhaust gas may not be sufficiently reduced.

However, in the muffler for a vehicle according to various embodiments of the present invention, the exhaust noise, flow-induced noise, and booming noise can be sufficiently reduced through the movement space of exhaust gas increased by second and third chambers 12 and 13, connection channels 41*a* and 44*a* of first and fourth baffles 41 and 44, sound-absorbing material 70 and 80 filled in first and fourth chambers 11 and 14, and first and second exhaust outflow pipes 51 and 52 making the dual pipe, such that it is possible to reduce the size of the muffler and the muffler can be used in small vehicles.

Further, in the muffler for a vehicle according to various embodiments of the present invention, heat insulating performance is considerably improved by sound-absorbing material 70 filled in first and fourth chambers 11 and 14, such that the muffler can be effectively protected against thermal damage from the vehicle and durability is largely improved.

Further, in the muffler for a vehicle according to various embodiments of the present invention, since the exhaust gas outflow pipe makes a dual pipe composed of first and second exhaust gas outflow pipes 51 and 52 and the outlet is positioned at the lower center of rear bumper 60 and exposed to the outside, a dynamic, powerful, and polished image can appeal to consumers, such that it is possible to considerably improve productivity of vehicles.

For convenience in explanation and accurate definition in the appended claims, the terms "lower", "front" or "rear", "inside" or "outside", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A muffler for a vehicle, comprising:

a plurality of baffles fixed at a predetermined distance in a longitudinal direction of a muffler housing within the muffler housing;

an exhaust gas inflow pipe having an inlet thereof connected with the muffler through a front of the muffler housing and an outlet thereof fixed inside the muffler housing through a first of the baffles;

an intermediate pipe fixed through a second of the baffles in the muffler housing such that an inlet thereof is positioned in line with the outlet of the exhaust gas inflow pipe in one chamber defined by the first and the second of the baffles; and a plurality of exhaust gas outflow pipes having an inlet thereof positioned with the outlet of the intermediate pipe in another chamber defined by the second and a third of the baffles such that the exhaust gas passing through the intermediate pipe is directly discharged outside the muffler housing though the plurality of exhaust gas outflow pipes, and an outlet thereof protruding outward through the muffler housing such that the discharging direction of the exhaust gas though the plurality of exhaust gas outflow pipes does not meet the input direction of the exhaust gas into the intermediate pipe, without passing through at least one of the baffles;

wherein a longitudinal axis of the plurality of exhaust gas outflow pipes and a longitudinal axis of the intermediate pipe are substantially perpendicular to each other.

2. The muffler for a vehicle as defined in claim 1, wherein the first, second, and third baffles are fixed at a predetermined distance in the longitudinal direction of the muffler housing in the muffler housing;

wherein the internal space of the muffler housing is divided into first, second, third, and fourth chambers by the first, second, and third baffles, wherein the exhaust gas inflow pipe outlet is positioned in the second chamber;

wherein the intermediate pipe is disposed through the second baffle in the longitudinal direction of the exhaust gas inflow pipe such that the intermediate pipe inlet is positioned in line with the exhaust gas inflow pipe outlet in the second chamber and the intermediate pipe outlet is positioned in the third chamber; and the exhaust gas outflow pipe is disposed such that the inlet thereof is positioned adjacent the outlet of the intermediate pipe in the third chamber, and the output thereof protrudes outside through a side of the muffler housing.

3. The muffler for a vehicle as defined in claim 2, wherein the exhaust gas outflow pipes includes a dual pipe having first and second exhaust gas outflow pipes.

4. The muffler for a vehicle as defined in claim 3, wherein outlets of the first and second exhaust gas outflow pipes are disposed adjacent a lower center of a rear bumper.

5. The muffler for a vehicle as defined in claim 3, wherein the first and fourth chambers are filled with a sound-absorbing material for improved heat insulating performance.

6. The muffler for a vehicle as defined in claim 5, wherein the sound-absorbing material is glass wool.

7. The muffler for a vehicle as defined in claim 5, wherein the first baffle has a plurality of connection channels connecting the first and second chambers to reduce exhaust noise and flow-induced noise.

8. The muffler for a vehicle as defined in claim 5, wherein the third baffle has a plurality of connection channels connecting the third and fourth chambers to reduce exhaust noise and flow-induced noise.

9. The muffler for a vehicle as defined in claim 1, wherein the exhaust gas inflow pipe and the intermediate pipe are co-axial and the diameters of the exhaust gas inflow pipe and the intermediate pipe are substantially the same.

* * * * *